US012366016B2

(12) United States Patent
Yam et al.

(10) Patent No.: US 12,366,016 B2
(45) Date of Patent: Jul. 22, 2025

(54) SYSTEMS, DEVICES AND METHOD FOR THREE-DIMENSIONAL SURFACE WEAVING

(71) Applicant: Centre for Perceptual and Interactive Intelligence (CPII) Limited, Hong Kong (HK)

(72) Inventors: Yeung Yam, Hong Kong (HK); Xiangjia Chen, Hong Kong (HK); Man Lip Lai, Hong Kong (HK); Changling Charlie Wang, Cheshire (GB); Man Tai Andy Wong, Hong Kong (HK)

(73) Assignee: Centre for Perceptual and Interactive Intelligence (CPII) Limited, Hong Kong (HK)

( * ) Notice: Subject to any disclaimer, the term of this patent is extended or adjusted under 35 U.S.C. 154(b) by 68 days.

(21) Appl. No.: 18/371,025

(22) Filed: Sep. 21, 2023

(65) Prior Publication Data

US 2024/0102213 A1 Mar. 28, 2024

(30) Foreign Application Priority Data

Sep. 26, 2022 (HK) ..... 22022061211.7

(51) Int. Cl.
*D03D 31/00* (2006.01)
*D03D 49/68* (2006.01)

(52) U.S. Cl.
CPC ..... *D03D 31/00* (2013.01); *D03D 49/68* (2013.01)

(58) Field of Classification Search
CPC ..... D03D 41/004; D03D 31/00; D03D 49/68
See application file for complete search history.

(56) References Cited

U.S. PATENT DOCUMENTS 5,158,116 A * 10/1992 Kazuo ..... D03D 49/62 139/192
5,431,193 A * 7/1995 Mood ..... D03D 41/004 139/192
5,449,025 A * 9/1995 Weinberg ..... D03D 41/004 139/55.1
6,000,442 A * 12/1999 Busgen ..... D03D 41/004 428/36.1
2018/0319618 A1* 11/2018 Beauduin ..... B65H 57/12

* cited by examiner

*Primary Examiner* — Patrick J. Lynch
*Assistant Examiner* — Brianna T. Duckworth
(74) *Attorney, Agent, or Firm* — Rivka Friedman

(57) ABSTRACT

Systems, devices and methods for three-dimensional surface weaving are disclosed herein. The system includes a jacquard device, a weaving device and a roller matrix. The jacquard device configured to selectively raise or lower the warp threads to form a shed for the weft thread to travel; the weaving device configured to carry the weft thread into the shed and weave the weft thread on the warp threads; and the roller matrix with individually controlled rotate apparatus configured to control the warp threads to move forward or backward. The warp threads come from rotate apparatus installed on the roller matrix. The rotate apparatus is controlled individually to forward or reverse rotate, so that the attached warp thread is able to be longer or shorter. As the warp threads can be shortened during weaving process, the three-dimensional surface can be produced.

9 Claims, 13 Drawing Sheets

SYSTEMS, DEVICES AND METHOD FOR THREE-DIMENSIONAL SURFACE WEAVING

TECHNICAL FIELD

The present disclosure relates to a field of the textile industry, and in particular to systems, devices, and methods for three-dimensional surface weaving.

BACKGROUND

Any discussion of the prior art throughout the specification should in no way be considered as an admission that such prior art is widely known or forms part of common general knowledge in the field.

Weaving is one of humanity's oldest technologies, which is related to clothes, architecture, and aerospace industry. The interweaving of warps and wefts produces a plain fabric which is hard to deform in the directions of warp thread and weft thread.

In 1804, Joseph Marie Jacquard invented a weaving machine with a jacquard loom which made possible the automatic production of varieties of complex pattern weaving. The weave pattern can set the appearance of fabric, including, e.g., matte velvet, shiny satin, and vibrant multicolor patterns; change the feel of the fabric, from, e.g., rough plain weave to fuzzy terry. The state-of-the-art weaving machine enables the weaving of thousands of heddles with computer-controlled and complex weave patterns due to the electronic version of the jacquard loom. Almost all of the existing weaving machines are designed to weave plain fabric no matter what different materials or complex patterns they apply.

Although there are some hand-woven products with 3D surfaces in our life, e.g., woven rattan chairs, the production process still cannot be automated and industrialized until a weaving machine with a 3D surface weaving function is made.

On the other hand, knitting, as another branch of ancient textile technology, has made huge progress in terms of 3D forming in recent decades. The latest research shows that it is possible to seamlessly knit a garment based on a 3D human model using a state-of-the-art knitting machine. However, there is a limitation in the material due to the structure of knitting knot, the material has to be soft and elastic, e.g., cotton. The knitting fabric shows isotropic properties and poor mechanical properties while being applied tensile force compared with weaving fabric.

Therefore, what is needed are techniques that overcome the above-mentioned disadvantages.

SUMMARY

According to various embodiments of the present disclosure, systems, devices, and methods for three-dimensional surface weaving are provided.

A system for three-dimensional surface weaving using warp threads and weft threads, the system comprising:

- a jacquard device configured to selectively raise or lower the warp threads to form a shed for the weft thread to travel;
- a weaving device configured to carry the weft thread into the shed and weave the weft thread on the warp threads; and
- a roller matrix with individually controlled rotate apparatus configured to control the warp threads to move forward or backward.

A weaving device for three-dimensional surface weaving using warp threads and weft threads, the device comprising:

- a reed comprising a first slice, a second slice, a third slice and a basement; the first slice and the third slice are fixed on the basement; the second slice is placed between the first slice and the third slice, and the second slice is movable to clamp or unclamp the warp threads; and
- a shuttle, the shuttle is movable along the reed and configured to carry the weft thread.

A method for three-dimensional surface weaving using warp threads and weft threads,

- the method is applied to the system for three-dimensional surface weaving of claim 1, the method comprising:
- the jacquard device selectively raises or lowers the warp threads to form a shed for the weft thread to travel;
- the weaving device carries the weft threads into the sheds and weaves the weft threads on the warp threads; and
- the roller matrix controls the warp threads to move forward or backward individually.

Details of one or more embodiments of the present disclosure will be given in the following description and attached drawings. Other features, objects and advantages of the present disclosure will become apparent from the description, drawings, and claims.

BRIEF DESCRIPTION OF THE DRAWINGS

In order to better describe and illustrate the embodiments and/or examples of the contents disclosed herein, reference may be made to one or more drawings. Additional details or examples used to describe the drawings should not be considered as limiting the scope of any of the disclosed contents, the currently described embodiments and/or examples, and the best mode of these contents currently understood.

DETAILED DESCRIPTION OF THE EMBODIMENTS

Figure 1:
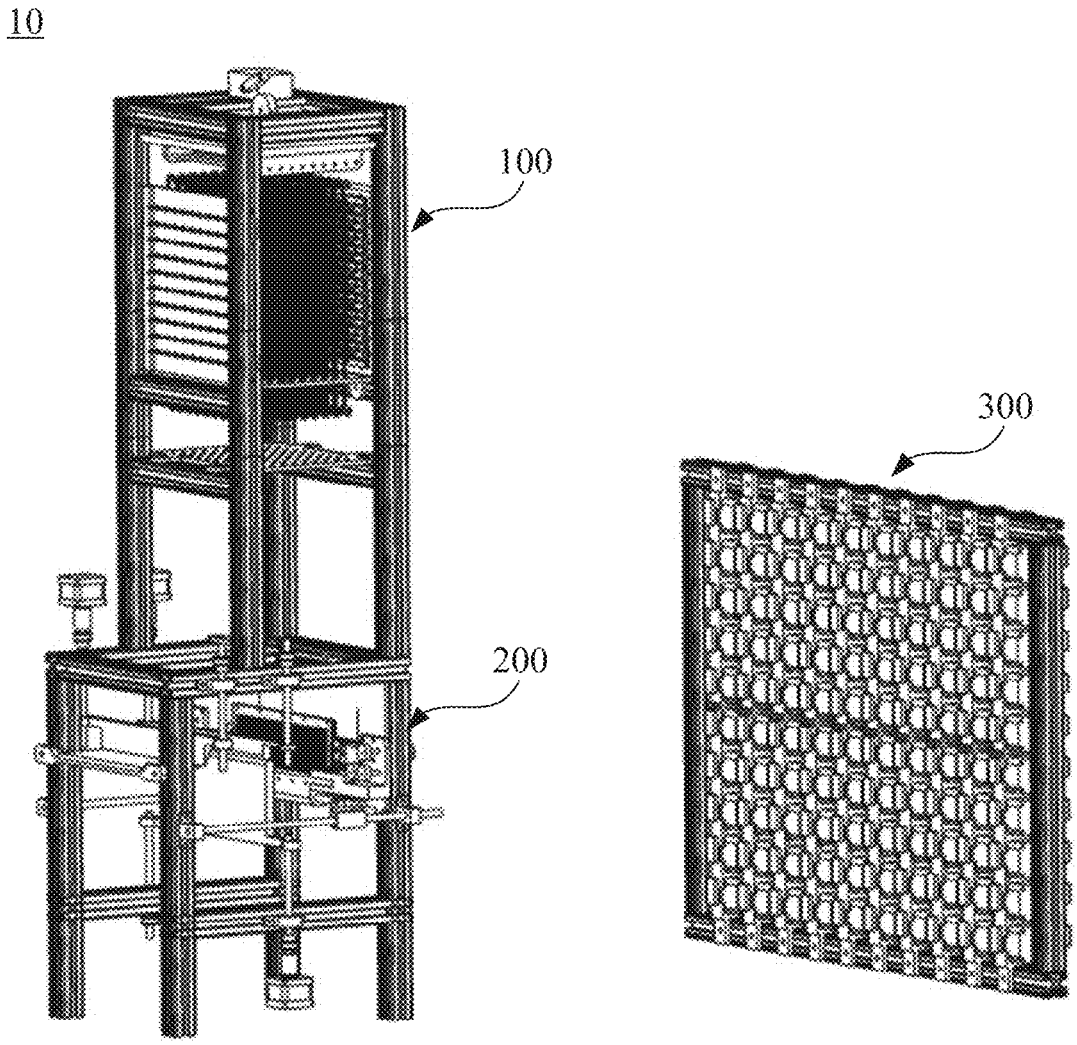
FIG. 1 illustrates a system for three-dimensional surface weaving, according to an embodiment of the present disclosure.

In order to facilitate the understanding of the present disclosure, the present disclosure will be described more fully below with reference to the relevant drawings. Preferred embodiments of the present disclosure are shown in the drawings. However, the present disclosure can be implemented in many different forms and is not limited to the embodiments described herein. On the contrary, the purpose of providing these embodiments is to make the disclosure of the present disclosure more thorough and comprehensive.

Unless otherwise defined, all technical and scientific terms used herein have the same meaning as commonly understood by one of ordinary skill in the art to which this invention belongs. The definitions are provided to aid in describing particular embodiments, and are not intended to limit the claimed invention. The term "and/or" used herein includes any and all combinations of one or more related listed items.

In order to understand this application thoroughly, detailed steps and structures will be provided in the description below to explain the technical solution proposed by this application. Preferred embodiments of this application are described in detail below. However, in addition to these details, there may be other embodiments of this application.

It should be noted that when an element is referred to as being "fixed to" another element, it can be directly on another element or an intervening element may also be present there between. When an element is considered to be "connected to" another element, it can be directly connected to another element or an intervening element may be present at the same time. Terms "inner", "outer", "upper", "lower", "left", "right" and similar expressions used herein are for illustrative purposes only, and do not mean that they are the only embodiments.

Referring to FIG. 1, a system 10 for three-dimensional surface weaving comprises a jacquard device 100, a weaving device 200 and a roller matrix 300. The system 10 is configured to weave fabric with three-dimensional surface by using warp threads and weft threads and enables 3D surface weaving function automatically.

Figure 2:
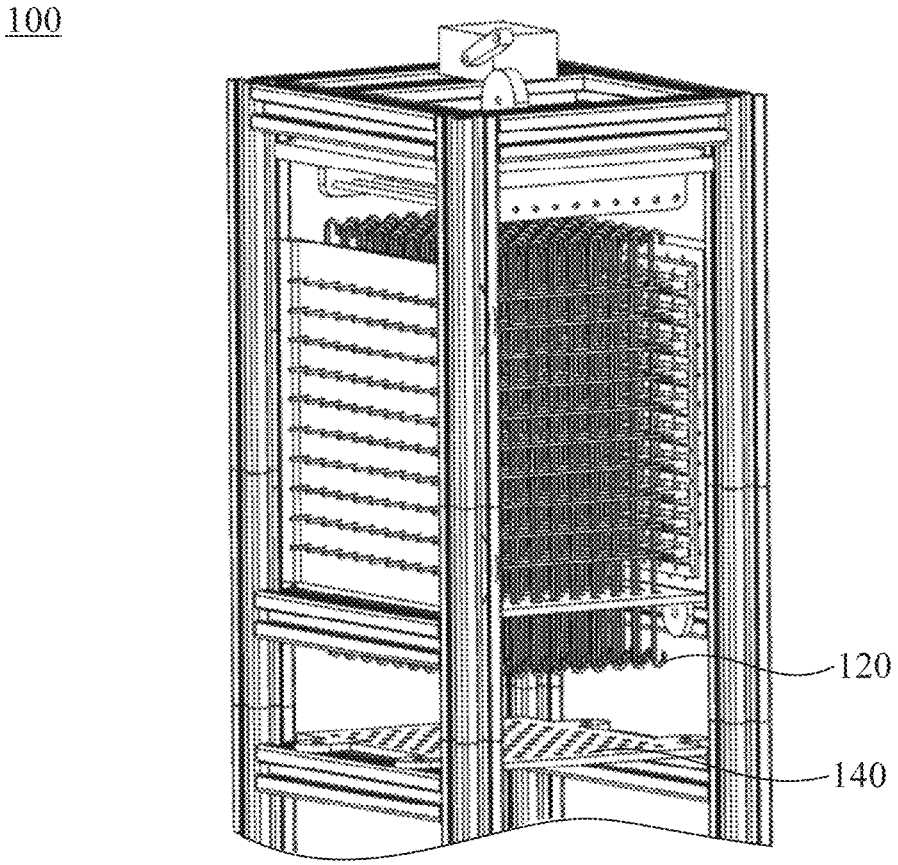
FIG. 2 illustrates a jacquard device of the system shown in FIG. 1.

Referring to FIG. 2, the jacquard device 100 is configured to selectively raise or lower the warp threads to form a shed for the weft thread to travel. The shed is a gap allowing the weft thread to interlace. In some embodiments, the jacquard device 100 can be located directly above the weaving device 200. The jacquard device 100 can be a full jacquard device 100. The jacquard device 100 can include heddles 120 and a rectification board 140. The heddles 120 can be controlled by computer programs to selectively raise or lower the warp threads. The heddles 120 go through the rectification board 140. The rectification board 140 can unify the lifting direction and magnitude for all selected heddles 120 when the jacquard device 100 is working. The warp threads and heddles 120 perpendicular to the same horizontal line where there are rings tied on the heddles 120 so that the warp threads can form a shed as the heddles 120 selectively raise or lower under the control of the jacquard device 100.

Figure 3:
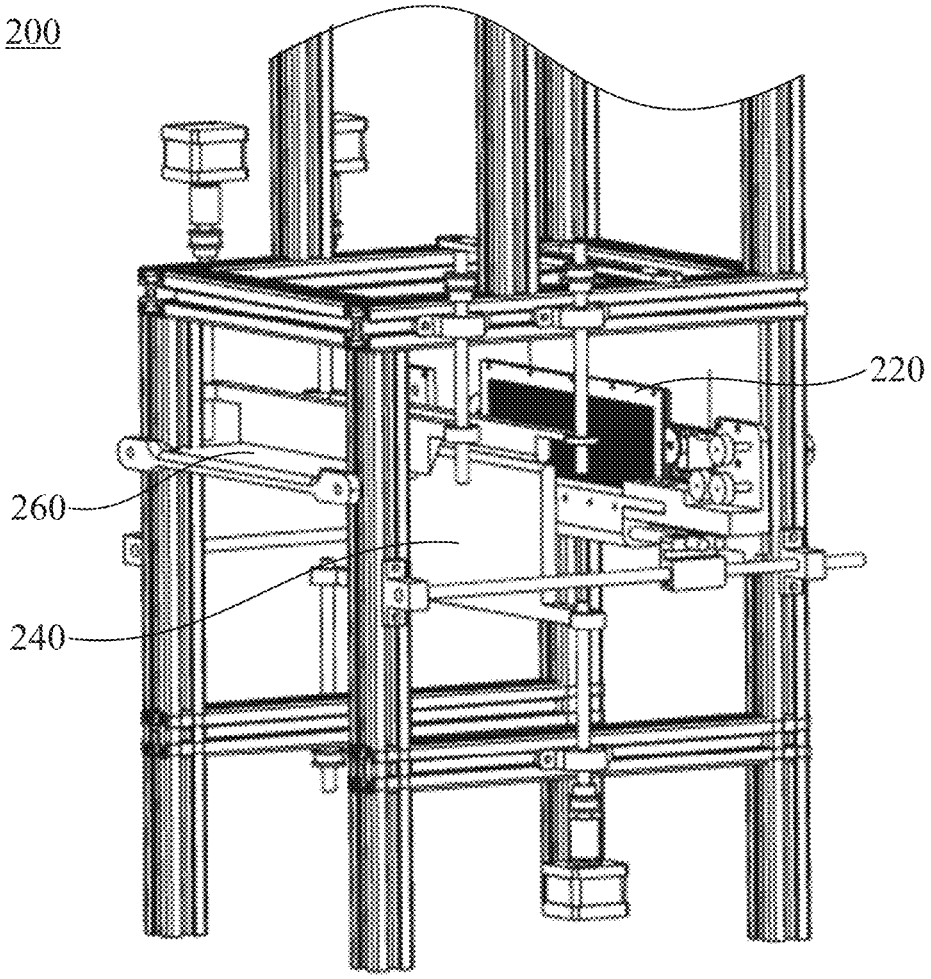
FIG. 3 illustrates a weaving device of the system shown in FIG. 1.

Referring to FIG. 3, the weaving device 200 is configured to carry the weft thread into the shed and weave the weft thread on the warp threads. The weaving device 200 comprises a reed 220 and a shuttle (not shown in FIG. 3), the shuttle is movable along the reed 220 and configured to carry the weft thread. The heddles 120 drawn from the jacquard device 100 dive into the weaving device 200 to control the warp threads. The heddles 120 selectively raise or lower the warp threads to form the shed, then the shuttle carries the weft thread into the shed. After that, the reed 220 moves to interlace the weft thread with the warp threads.

Figure 4:
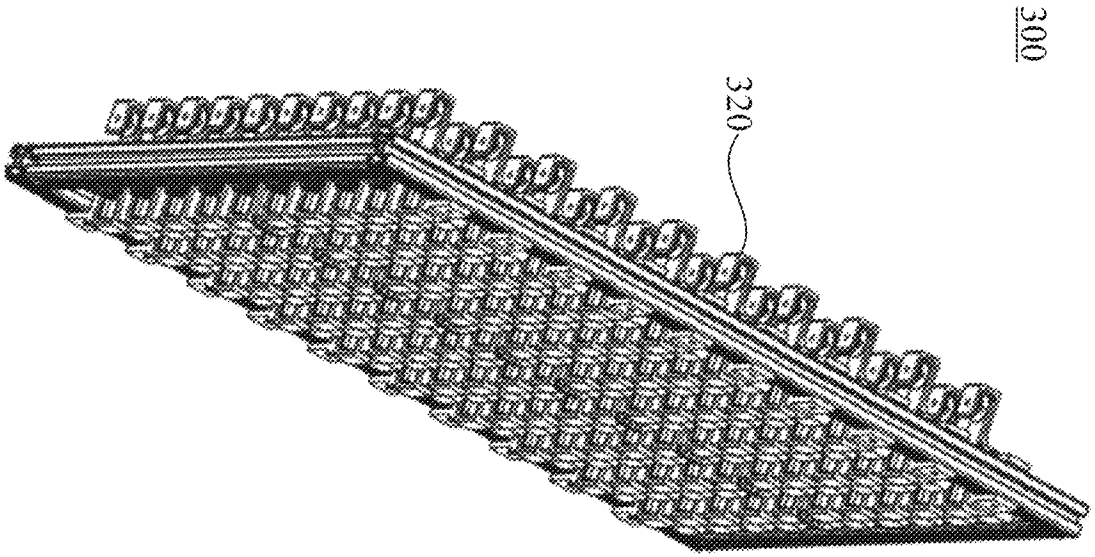
FIG. 4 illustrates a roller matrix of the system shown in FIG. 1.

Referring to FIG. 4, the roller matrix 300 is configured to control the warp threads to move forward or backward. The roller matrix 300 is mainly responsible for sending or collecting warp threads individually. The roller matrix 300 includes individually controlled rotate apparatus 320. In some embodiments, one rotate apparatus 320 controls one of the warp threads to move forward or backward.

Figure 5:
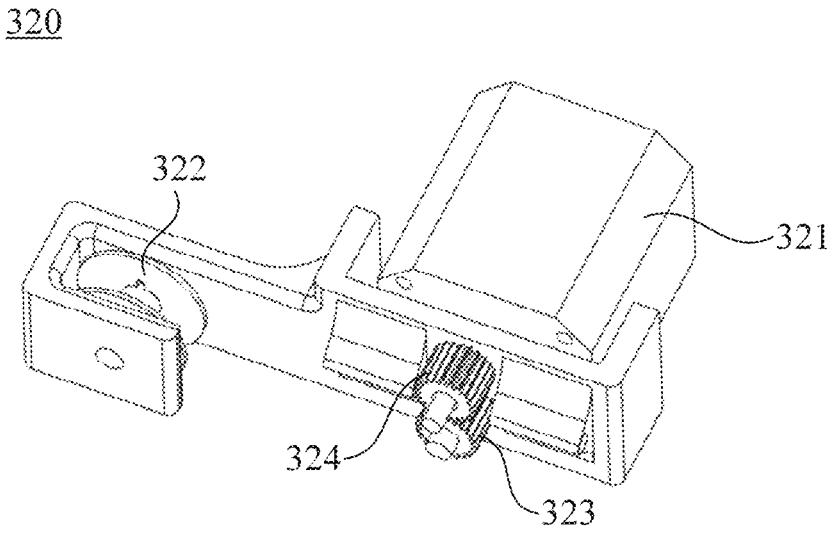
FIG. 5 illustrates a rotate apparatus of the roller matrix shown in FIG. 4.

Referring to FIG. 5, the rotate apparatus 320 can be driven by a step motor 321, the step motor 321 is configured to drive the warp thread forward or backward. In an embodiment, the rotate apparatus 320 can further comprise a coil 322, a driving gear 323 and a driven gear 324. The coil 322 is configured to coil 322 the warp thread. The driving gear 323 is driven by the step motor 321. The driving gear 323 meshes with the driven gear 324, and driving gear 323 and the driven gear 324 are configured to clamp the warp thread to move forward or backward. The warp thread is released from the coil 322 and goes through a positioning hole to a position between the driving gear 323 and the driven gear 324. The driving gear 323 is driven by the step motor 321 which could rotate forward or inverse. The driving gear 323 meshes with driven gear 324, so the warp thread is clamped inside. As the driving gear 323 rotates, the warp thread will be sent or collected to realize individually controlling function.

The warp threads come from rotate apparatus 320 installed on the roller matrix 300. The rotate apparatus 320 is controlled individually to forward or reverse rotate according to W-code converted from a three-dimensional surface, so that the attached warp thread is able to be longer or shorter. As the warp threads can be shortened during weaving process, the three-dimensional surface can be produced. Compared with handmade three-dimensional surface weaving, the system 10 enables 3D surface weaving function automatically. Compared with three-dimensional knitting fabric, the three-dimensional weaving products of the system 10 shows good mechanical properties.

Figure 6:
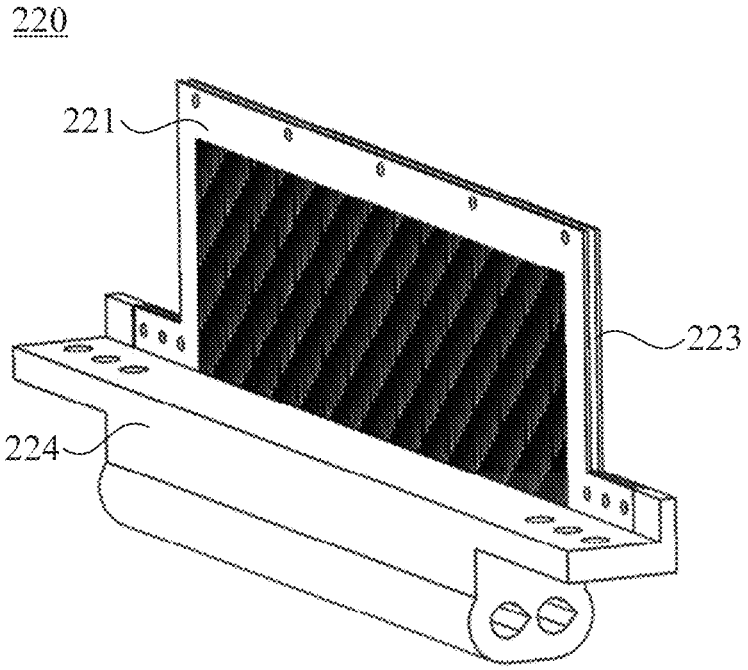
FIG. 6 illustrates a reed of the weaving device shown in FIG. 3.
Figure 7:
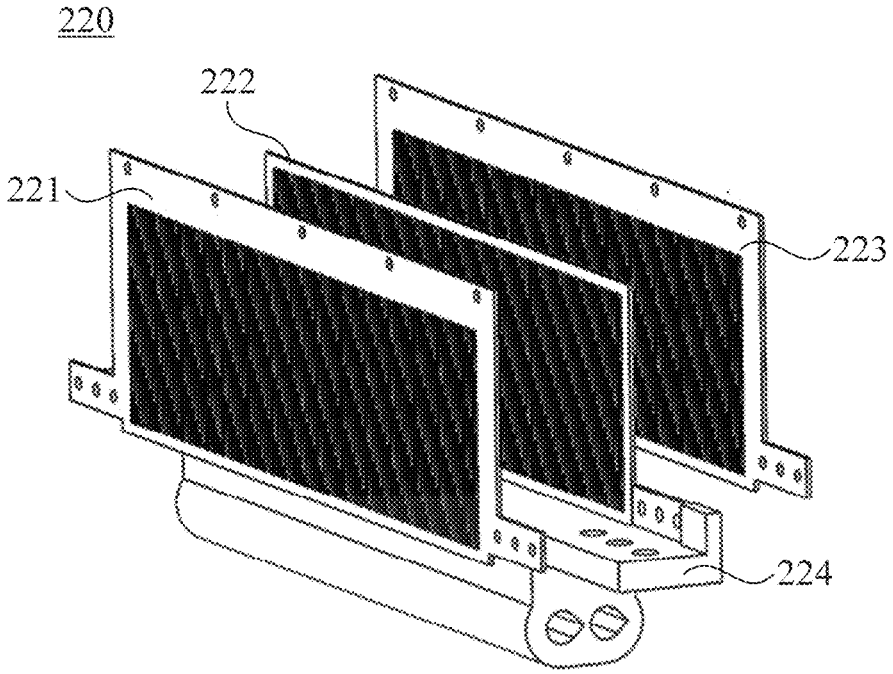
FIG. 7 illustrates an exploded view of the reed shown in FIG. 6.

In some embodiments, the weaving device 200 can be also improved. Referring to FIGS. 6-7, in this embodiment, the reed 220 includes a first slice 221, a second slice 222, a third slice 223 and a basement 224; the first slice 221 and the third slice 223 are fixed on the basement 224; the second slice 222 is placed between the first slice 221 and the third slice 223. The second slice 222 is movable to clamp or unclamp the warp threads. In an embodiment, the second slice 222 has freedom of left and right movement. The three-piece reed 220 moves along the direction of warp threads. In an embodiment, the first slice 221, the second slice 222 and the third slice 223 are grid slices. All the slices have strip holes and when the second slice 222 moves to a specific position, the strip holes of these slices are passable for warp threads. Instead, when the second slice 222 moves a little bit from the specific position, the passages close and the warp threads are clamped.

Figure 8:
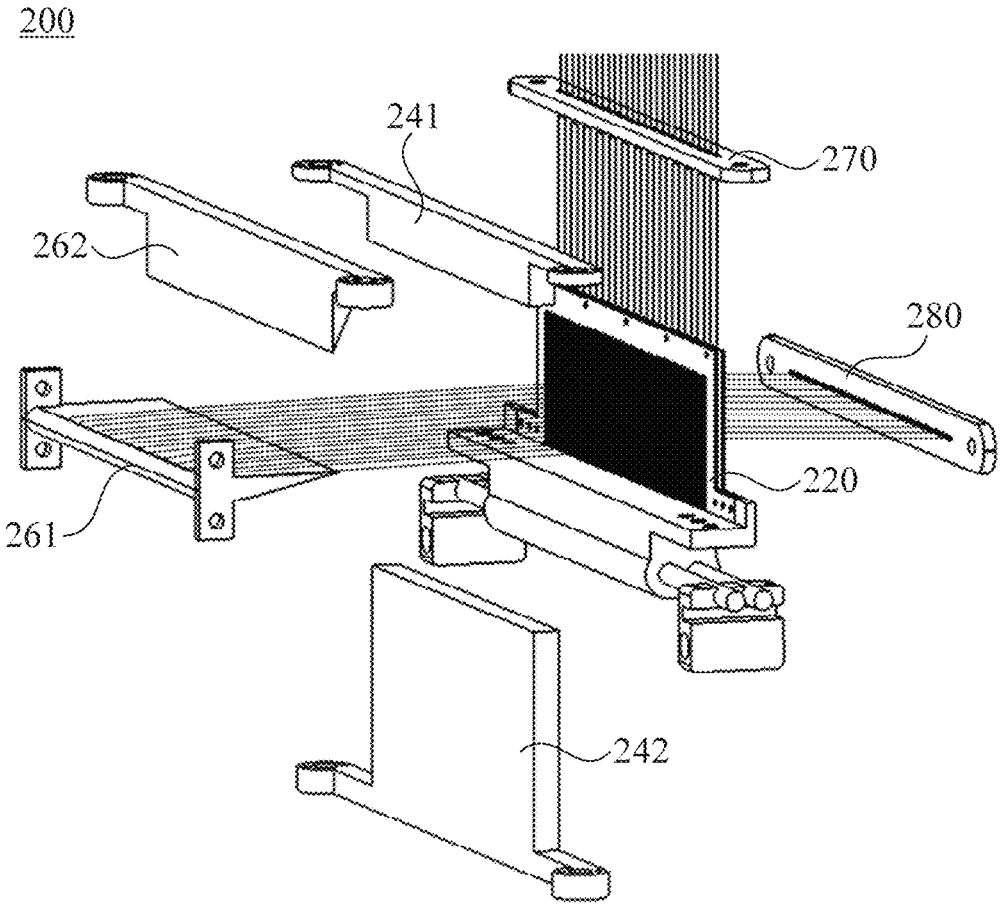
FIG. 8 illustrates a schematic diagram of the weaving device shown in FIG. 3.
Figure 9:
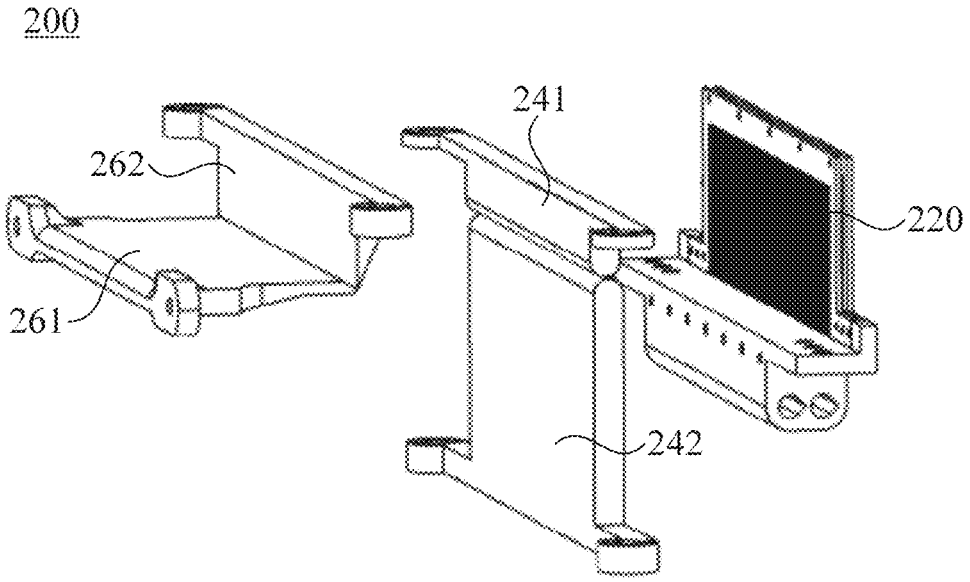
FIG. 9 illustrates another schematic diagram of the weaving device shown in FIG. 3.

Further, referring to FIGS. 3, 8 and 9, in some embodiments, the weaving device 200 further includes a gate 240 located in middle of the weaving device 200; the gate 240 is configured to open to let the reed 220 pass or close to make the warp threads at same height. The gate 240 can include a first gate part 241 and a corresponding second gate part 242. In this embodiment, the first gate part 241 and second gate part 242 can move vertically. When the gate 240 is open, the reed 220 can pass. When the gate 240 is closed, the first gate part 241 and second gate part 242 can clamp the warp threads to make all the warp threads at same height.

In some embodiments, the weaving device 200 can further comprise a collection apparatus 260. The collection apparatus 260 includes of a platform 261 and a movable clamping piece 262, the clamping piece 262 is configured to press finished fabric on the platform 261. To prevent the finished fabric from slipping, the clamping piece 262 will press the finished fabric on the platform 261 until the new weft is interlaced.

Figure 10:
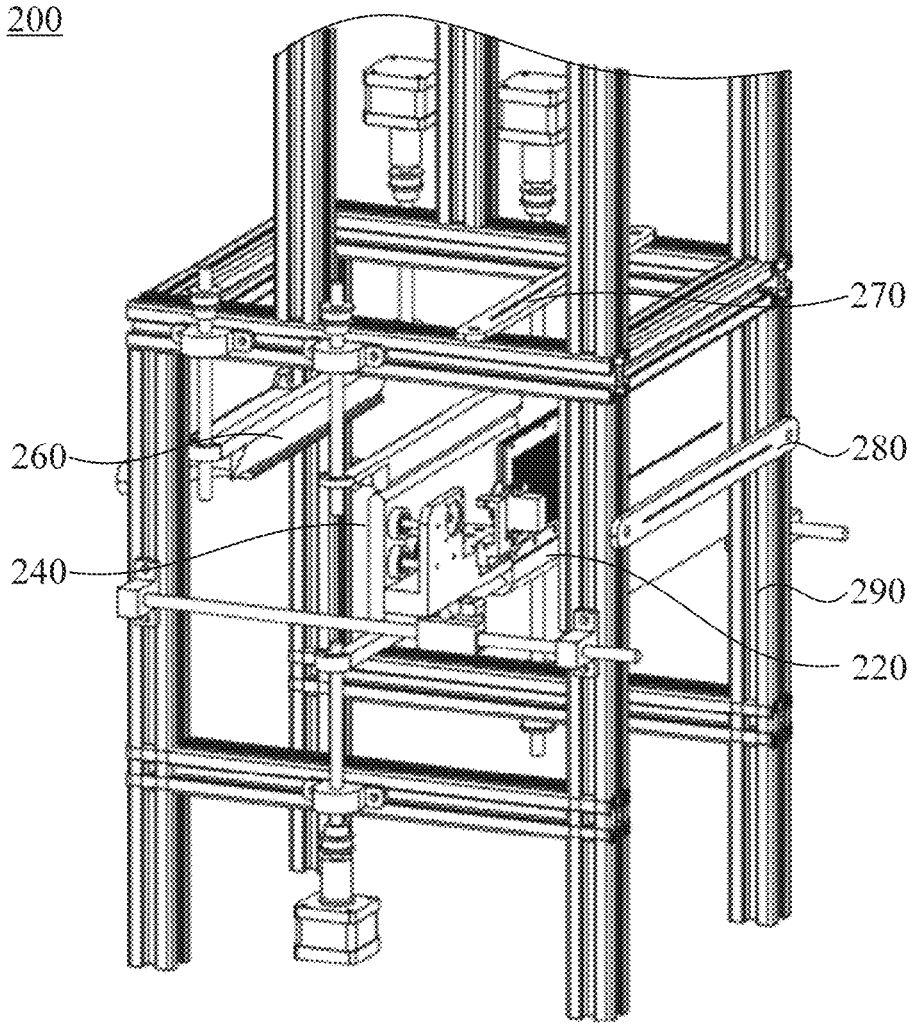
FIG. 10 illustrates another view of the weaving device shown in FIG. 3.
Figure 11:
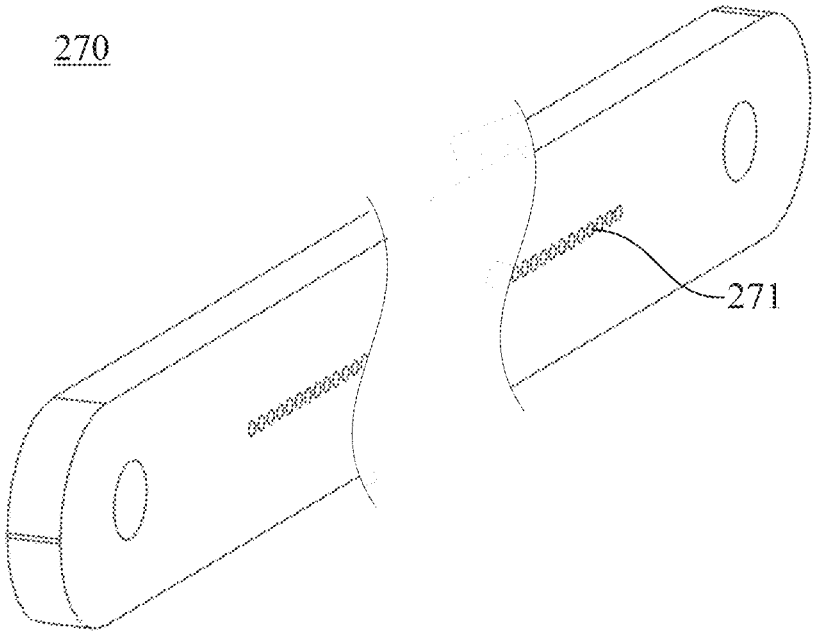
FIG. 11 illustrates a heddle hole board of the weaving device shown in FIG. 3.

Referring to FIGS. 10-11, in some embodiments, the weaving device 200 can comprise a heddle hole board 270. The heddle hole board 270 is provided with a row of heddle holes 271. The heddles 120 go through the rectification board 140, and then go through the row of the heddle holes 271 to connect the warp threads. In some embodiments, the weaving device 200 can comprise a warp hole board 280. The structure of the warp hole board 280 is similar to heddle hole board 270. The warp hole board 280 is provided with a row of warp holes. The warp threads from the roller matrix 300 go through the row of the warp holes.

The weaving device 200 also includes a gantry 290. In this embodiment, the reed 220, the gate 240, the collection apparatus 260, the heddle hole board 270 and the warp hole board 280 are mounted on the gantry 290. The movement of the reed 220, the gate 240 and the collection apparatus 260 can be driven by motors and lead screws.

Figure 12:
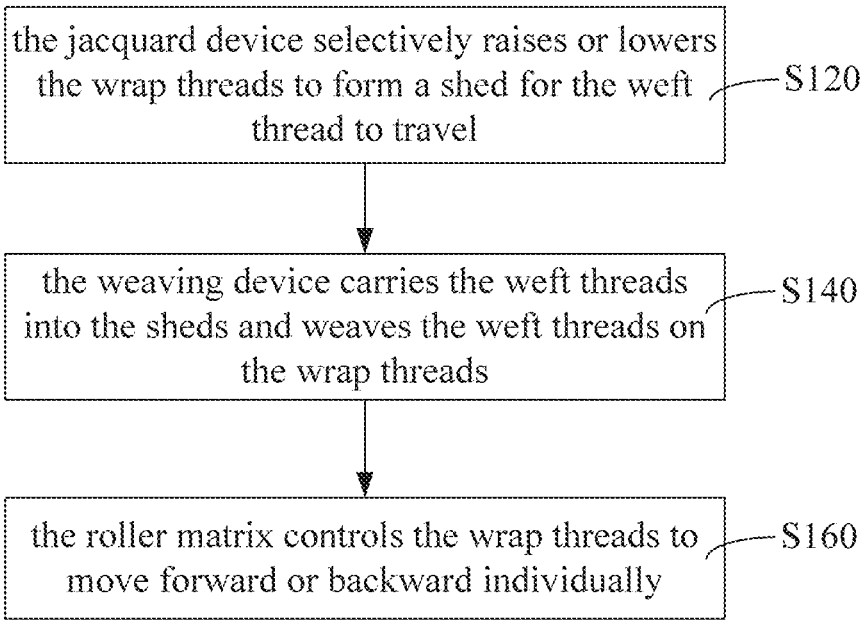
FIG. 12 illustrates a flowchart for a method for three-dimensional surface weaving implemented by the system shown in FIGS. 1-11, according to an embodiment of the present disclosure.

Referring to FIG. 12, the method for three-dimensional surface weaving using warp threads and weft threads is also provided. The method is applied to the system 10. The method comprises the following steps:

S120: the jacquard device 100 selectively raises or lowers the warp threads to form a shed for the weft thread to travel;

S140: the weaving device 200 carries the weft threads into the sheds and weaves the weft threads on the warp threads; and S160: the roller matrix 300 controls the warp threads to move forward or backward individually.

Figure 13:
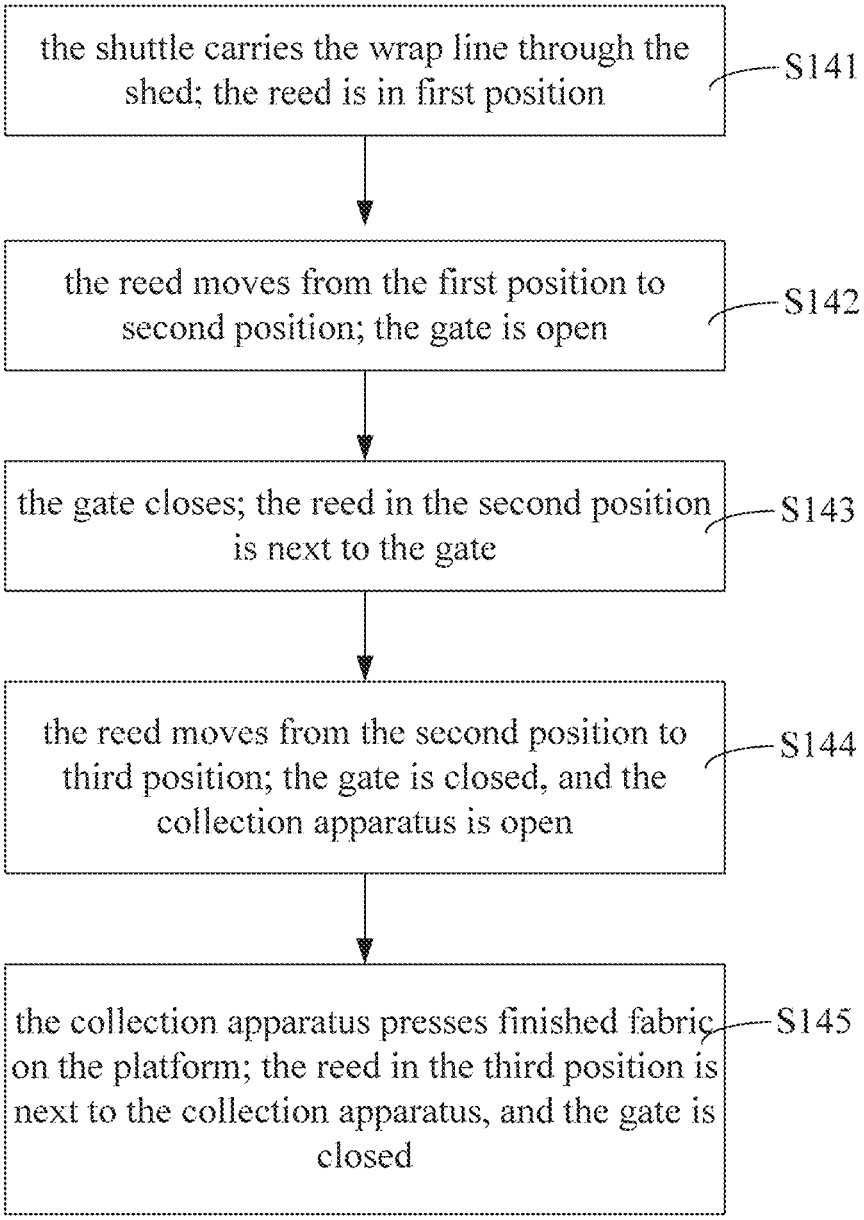
FIG. 13 illustrates a flowchart for a method for three-dimensional surface weaving implemented by the system shown in FIGS. 1-11, according to another embodiment of the present disclosure.

In some embodiments, Referring to FIG. 13, the step S140 comprises the following steps:

S141: the shuttle carries the warp line through the shed; the reed 220 is in first position;

S142: the reed 220 moves from the first position to second position; the gate 240 is open;

S143: the gate 240 closes; the reed 220 in the second position is next to the gate 240;

S144: the reed 220 moves from the second position to third position; the gate 240 is closed, and the collection apparatus 260 is open; and S145: the collection apparatus 260 presses finished fabric on the platform 261; the reed 220 in the third position is next to the collection apparatus 260, and the gate 240 is closed.

The warp threads come from rotate apparatus 320 installed on the roller matrix 300. The rotate apparatus 320 is controlled individually to forward or reverse rotate according to W-code converted from a three-dimensional surface, so that the attached warp thread is able to be longer or shorter. As the warp threads can be shortened during weaving process, the three-dimensional surface can be produced. Compared with handmade three-dimensional surface weaving, the system 10 enables 3D surface weaving function automatically. Compared with three-dimensional knitting fabric, the three-dimensional weaving products of the system 10 shows good mechanical properties.

The technical features in the foregoing embodiments may be randomly combined. For concise description, not all possible combinations of the technical features in the embodiment are described. However, provided that combinations of the technical features do not conflict with each other, the combinations of the technical features are considered as falling within the scope recorded in this specification.

The foregoing embodiments only describe several implementations of the disclosure, which are described specifically and in detail, and therefore cannot be construed as a limitation to the patent scope of the disclosure. It should be noted that, a person of ordinary skill in the art may further make variations and improvements without departing from the ideas of the disclosure, which all fall within the protection scope of the disclosure. Therefore, the protection scope of the disclosure is subject to the protection scope of the appended claims.

What is claimed is:

1. A system for three-dimensional surface weaving using warp threads and weft threads, the system comprising:

a jacquard device configured to selectively raise or lower the warp threads to form a shed for the weft thread to travel;

a weaving device configured to carry the weft thread into the shed and weave the weft thread on the warp threads; and a roller matrix with an individually controlled rotate apparatus configured to control the warp threads to move forward or backward;

wherein the rotate apparatus includes a step motor, the step motor is configured to drive the warp thread forward or backward; the rotate apparatus further includes a coil, a driving gear and a driven gear; the coil is configured to store the warp thread; the driving gear is driven by the step motor; the driving gear meshes with the driven gear, and driving gear and the driven gear are configured to clamp the warp thread to move the warp thread forward or backward.

2. The system for three-dimensional surface weaving of claim 1, wherein the weaving device includes a reed and a shuttle, the shuttle is movable along the reed and configured to carry the weft thread;

the reed includes a first slice, a second slice, a third slice and a basement; the first slice and the third slice are fixed on the basement; the second slice is placed between the first slice and the third slice, and the second slice is movable to clamp or unclamp the warp threads.

3. The system for three-dimensional surface weaving of claim 2, wherein the weaving device further includes a gate located in a middle of the weaving device;

the gate is configured to open to let the reed pass and close to prevent the reed from passing and clamp all the warp threads at a same height.

4. The system for three-dimensional surface weaving of claim 2, wherein the weaving device further includes a collection apparatus;

the collection apparatus includes a platform and a movable clamping piece, the clamping piece is configured to press a finished fabric on the platform.

5. The system for three-dimensional surface weaving of claim 2, wherein the weaving device further includes a gantry, a heddle hole board and a warp hole board; the heddle hole board is provided with a row of heddle holes; the warp hole board is provided with a row of warp holes; the reed, the heddle hole board and the warp hole board are mounted on the gantry.

6. A method for three-dimensional surface weaving using warp threads and weft threads, the method is applied to the system for three-dimensional surface weaving of claim 1, the method comprising:

the jacquard device selectively raises or lowers the warp threads to form a shed for the weft thread to travel;

the weaving device carries the weft threads into the sheds and weaves the weft threads on the warp threads; and the roller matrix controls the warp threads to move forward or backward individually.

7. The method for three-dimensional surface weaving of claim 6, wherein the weaving device includes a reed and a shuttle, the shuttle is movable along the reed and configured to carry the weft thread; the weaving device further includes a gate located in middle of the weaving device; the gate is configured to open to let the reed pass and close to prevent the reed from passing and clamp all the warp threads at a same height; the weaving device further includes a collection apparatus; the collection apparatus includes a platform and a movable clamping piece, the clamping piece is configured to press a finished fabric on the platform;

wherein when the weaving device carries the weft threads into the sheds and weaves the weft threads on the warp threads, the following steps occur:

the shuttle carries the warp line through the shed while the reed is in a first position;

then, the reed moves from the first position to a second position; while the gate is open;

then, the gate closes; while the reed is in the second position next to the gate;

then, the reed moves from the second position to a third position while the gate is closed and the collection apparatus is open; and then, the collection apparatus presses the finished fabric on the platform while the reed is in the third position is next to the collection apparatus and the gate is closed.

8. A weaving device for three-dimensional surface weaving using warp threads and weft threads, the device comprising:

a reed comprising a first slice, a second slice, a third slice and a basement; the first slice and the third slice are fixed on the basement; the second slice is placed between the first slice and the third slice, and the second slice is movable to clamp or unclamp the warp threads; and a shuttle, the shuttle is movable along the reed and configured to carry the weft thread;

a roller matrix with an individually controlled rotate apparatus configured to control the warp threads to move forward or backward;

wherein the rotate apparatus includes a step motor, the step motor is configured to drive the warp thread forward or backward; the rotate apparatus further includes a coil, a driving gear and a driven gear; the coil is configured to store the warp thread; the driving gear is driven by the step motor; the driving gear meshes with the driven gear, and driving gear and the driven gear are configured to clamp the warp thread to move the warp thread forward or backward.

9. The weaving device for three-dimensional surface weaving of claim 8, wherein the weaving device further includes a gate located in middle of the weaving device and a collection apparatus;

the gate is configured to open to let the reed pass and close to prevent the reed from passing and clamp all the warp threads at a same height;

the collection apparatus includes a platform and a movable clamping piece, the clamping piece is configured to press a finished fabric on the platform.

* * * * *